United States Patent [19]

Powell

[11] Patent Number: 4,868,710

[45] Date of Patent: Sep. 19, 1989

[54] CLEAN ROOM GARMENT

[75] Inventor: Keith Powell, Toccoa, Ga.

[73] Assignee: Coats and Clark Inc., Toccoa, Ga.

[21] Appl. No.: 183,584

[22] Filed: Apr. 19, 1988

[51] Int. Cl.[4] ..... A41D 13/00; H02H 1/00

[52] U.S. Cl. ..... 361/212; 2/51; 2/69; 2/60; 2/244; 57/901; 361/220

[58] Field of Search ..... 361/220, 212; 2/51, 2/60, 69, 1, 244, 275; 57/901; 66/202

[56] References Cited

U.S. PATENT DOCUMENTS

| | | | |
|---|---|---|---|
| 3,596,134 | 7/1971 | Burke | 361/220 |
| 3,699,590 | 10/1972 | Webber et al. | 2/73 |
| 4,422,483 | 12/1983 | Zins | 2/69 X |
| 4,590,623 | 5/1986 | Kitchman | 57/901 |
| 4,596,053 | 6/1986 | Cohen et al. | 361/212 X |
| 4,654,748 | 3/1987 | Rees | 361/220 |
| 4,753,088 | 6/1988 | Harrison et al. | 66/202 |

*Primary Examiner*—H. Hampton Hunter

*Attorney, Agent, or Firm*—Burgess, Ryan & Wayne

[57] ABSTRACT

An article for removing static electricity includes a clean room garment to be worn by a person, the garment including a grid of electrical thread throughout for removing and collecting static electricity from the person; a metal snap at a front waist section of the garment; and an electrical coupling thread in electrical contact from cuff to cuff and electrically connected to the snap for collecting static electricity from the grid and for supplying the collected static electricity to the snap for electrical discharge thereat.

6 Claims, 2 Drawing Sheets

CLEAN ROOM GARMENT

BACKGROUND OF THE INVENTION

The present invention relates generally to garments and, more particularly, is directed to a garment that can be used to remove static electricity in a clean room.

When handling static sensitive electronic components, such as intergrated circuits and the like, there is a problem of damaging such components due to static electricity. One method of grounding such static electric charges has been to provide a wrist strap about the wrist of the individual handling such components, which is in contact with the skin and is connected to ground by a wire connected to the wrist strap. As a result, the electrostatic charge accumulation on the individual is dissipated and the accumulation of additional electrostatic charge is prevented. Such conductive wrist straps are also provided in situations where the individual can be hurt, for example, in the proximity of an explosive or hazardous environments. Wrist bands of this type are shown and disclosed, for example, in U.S. Pat. Nos. 4,373,175; 4,459,633; 4,475,141; 4,398,277; and 4,654,748, the entire disclosure of the later U.S. Pat. No. 4,654,748 being incorporated herein by reference.

With such wrist bands, an electrical cable is connected to a strap on the wrist band for dissipating the static electricity. However, such wrist straps generally only remove electricity from the body or skin of the person. In addition, such wrist straps are disadvantageous since they provide limited freedom of movement. This is because the wrist of a person moves over the greatest range of distance while working in an electrical clean room.

As aforementioned, such conventional wrist straps only remove static electricity from the body or skin of a person. However, static electricity also exists on the clothing of a person. In this regard, U.S. Pat. No. 4,680,668 discloses a wrist strap which attaches to the cuff of a garment to remove static electricity therefrom. However, the problem of limited range of movement remains.

U.S. Pat. No. 3,596,134 discloses apparatus for discharging electrostatic energy in which a belt 10*a* is attached around the waist of the person and has a flexible lead 36 with a clip member 38 at the free end thereof. Such apparatus also includes garters 10 and boots 14 for removing static electricity. However, such device is extremely cumbersome and unwieldy, particularly with the view to quickly and easily removing and/or wearing the different parts.

It is also known to remove static electricity from garments by providing an antistatic garment, for example, as sold by Angelica Uniform Group of St. Louis, Mo. and in this regard reference is made to U.S. Pat. No. 4,422,483 owned by this same company, and the entire disclosure of which is incorporated herein by reference. Such garments remove static electricity from the body of the person and static electricity that is collected in the garment itself. However, there is no means for removing such static electricity from the garment itself.

Attention is also directed to U.S. Pat. Nos. 3,699,590; 4,605,984; 4,577,256; 4,567,094; 3,678,675; 3,803,453; 3,823,035; 3,857,397; 4,104,695; 4,107,755; 4,523,252; 4,638,399; 4,619,275; 4,639,825; 4,662,695; 4,664,158; 4,676,561; and 4,677,521; the Handbook of Electrostatic Discharge Controls; and The Book of "Physical Principles", pages 27, 54–57, 72–75 and 96–99.

OBJECTS AND SUMMARY OF THE INVENTION

Accordingly, it is an object of the present invention to provide a garment for removing static electricity.

More particularly, it is an object of the present invention to provide a garment that can be used for removing static electricity in an electrical clean room.

It is another object of the present invention to provide a garment having conductors running therethrough for removing static electricity from the body of a person and including means for removing the static electricity from the garment.

It is still another object of the present invention to provide such a garment in which the means for removing static electricity includes ground connection means at the waist of the garment which permits maximum freedom of movement of the person.

In accordance with an aspect of the present invention, an article for removing static electricity includes a garment to be worn by a person, the garment including a waist section and a grid of electrical threads throughout for removing and collecting the static electricity from the person; electrical connection means at the waist section for connection to electrical discharge means; an electrical coupling thread means in electrical contact with the grid for collecting static electricity from the grid and for supplying the collected static electricity to the electrical connection means for electrical discharge thereat.

The above and other objects, features and advantages of the present invention will become readily apparent from the following detailed description thereof which is to be read in connection with the accompanying drawings.

DETAILED DESCRIPTION OF A PREFERRED EMBODIMENT

Figure 1:
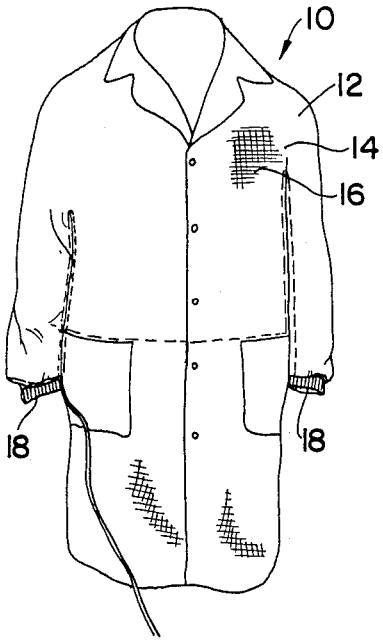
FIG. 1 is a front plan view of a garment according to the present invention.
Figure 2:
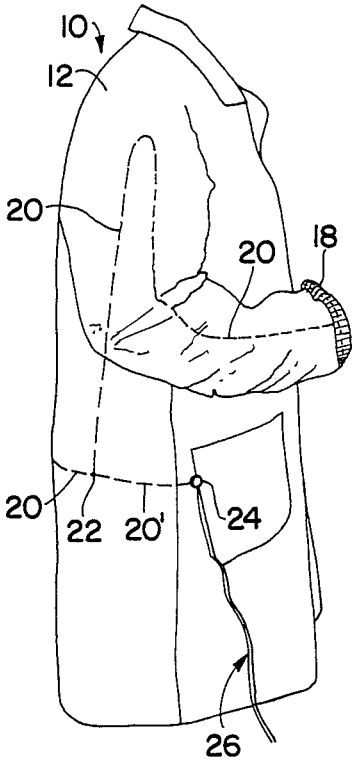
FIG. 2 is a side view of the garment of FIG. 1.
Figure 3:
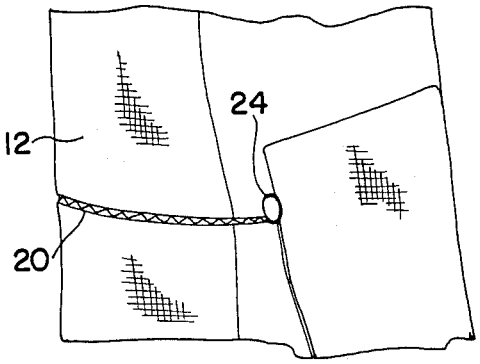
FIG. 3 is an enlarged side view of a portion of the garment of FIG. 2.

Referring to the drawings in detail, an initially to FIGS. 1–3, an article 10 according to the present invention for removing static electricity from the body of a person includes a garment 12 which, as shown, can be a conventional clean room jacket sold by Angelica Uniform Group of St. Louis, Mo. Such garment, as is well known, has a grid 14 of electrical threads 16 running throughout garment 12. Only a small area of the electrical threads are shown in FIG. 1 and it is to be appreciated that such threads run throughout the garment 12. Such garment is preferably one constructed in accordance with U.S. Pat. No. 4,422,483, the entire disclosure of which is incorporated herein by reference, and is designed to remove static electricity from grid 14 and collect such static electricity in grid 14.

Figure 4:
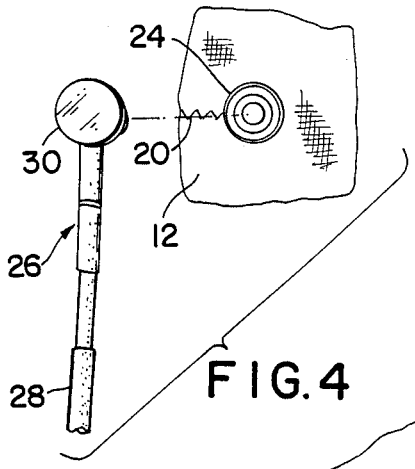
FIG. 4 is a perspective view of the electrical discharge snap connection to the garment of FIG. 1.

In accordance with the present invention, garment 12 is formed with a conductive wrist band sewn into the cuffs of garment 12. Wrist band 18 can be of the type disclosed in commonly assigned U.S. Pat. No. 4,654,748, the entire disclosure of which is incorporated herein by reference. In addition, an electrical coupling thread 20 extends from each wrist band 18, up the inseam of the arm portion of garment 12, down the inseam at the side of garment 12 and around the back of garment 12. As a result, a conductive path is established between the two conductive wrist bands 18. In addition, as shown best in FIG. 2, at the point where electrical coupling thread 20 from the side meets the electrical coupling thread 20 from the back, that is, at point 22 on one side of garment 12, electrical coupling thread 20 further extends toward the front of garment 12, as shown at 20' and terminates near the front of garment 12 at an electrical connection 24 such as a metal snap. At such position, as best shown in FIG. 4, electrical discharge means 26, which includes an electrical wire 28 having a corresponding snap 30 at the free end thereof can snap into snap 24 and electrically connect wire 28 to electrical coupling thread 20.

As a result, any static electricity from the person collected in grid 14 is carried by electrical coupling thread 20 which transverses the same, to electrical connection 24 and out through wire 28 to be discharged to a ground point. Because electrical connection 24 is positioned at the front waist section of garment 12, it provides maximum freedom of movement for the user.

Figure 7:
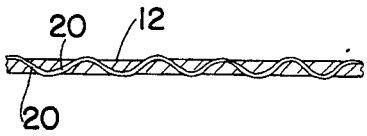

Preferably, electrical coupling thread 20 is connected to garment 12 in a zig-zag pattern, as shown in FIGS. 3 and 7 so as to ensure maximum contact with grid 14 in order to remove static electricity therefrom.

Electrical coupling thread 20 can be a model filament thread, such as disclosed in U.S. patent application Ser. No. 047,776, filed May 8, 1987 to the same assignee herewith and the entire disclosure of which is incorporated herein by reference.

Figure 8:
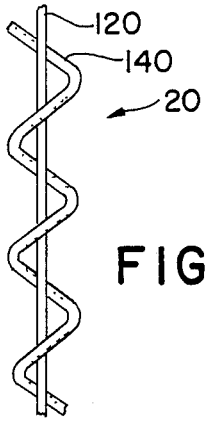
FIG. 7 is a cross-sectional view of the garment of FIG. 1 with the electrical coupling thread extending in a zig-zag manner therethrough and FIG. 8 is a schematic elevational view of a coupling thread that can be used with the present invention.

As shown in FIG. 8, electrical coupling thread (20) includes a continuous non-conductive thread (120) and a continuous metal thread (140) relatively wrapped around each other. For example, such thread can be a polyester/0.001 inch stainless thread sold by Coats and Clark of Stamford, Conn., under the trademark "Helix Tex 42".

Figure 5:
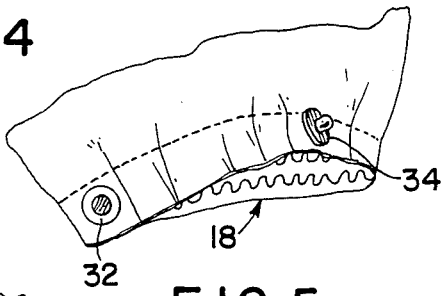
FIG. 5 is a perspective view of a wrist cuff of the garment of FIG. 1.
Figure 6:
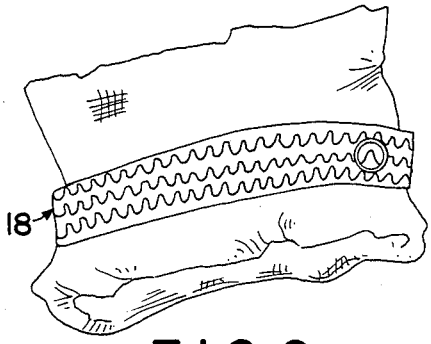
FIG. 6 is a perspective view of the cuff of FIG. 5 being inverted.

It will be appreciated that various modifications can be made to the present invention within the scope of the claims. For example, in FIGS. 5 and 6, wrist band 18 is shown as having snaps 32 and 34 which can tighten wrist band 18 about the wrist of a person. Alternatively, a stretchable wrist band such as that commonly used in the game of tennis, can be used to assure a tight fit with the wrist of the person.

Having described a specific preferred embodiment of the invention with reference to the accompanying drawings, it will be appreciated that the present invention is not limited to that precise embodiment, and that various changes and modifications can be effected therein by one of ordinary skill in the art without departing from the spirit or scope of the invention as defined in the appended claims.

What is claimed is:

1. An article for removing static electricity, comprising:

a garment to be worn by a person, said garment including a body covering section a waist section, two cuff sections and a grid of electrical threads throughout for collecting and removing the static electricity from the person;

a conductive elastic wrist band sewn into at least one of said cuff sections electrical connection means at said waist section for connection to electrical discharge means; said electrical connection means being electrically coupled to said grid and electrical coupling thread means for electricaly connecting said conductive elastic wrist band with said grid, said collected static electricity from said grid and static electricity from the person through said wrist band and said grid being supplied to said electrical connection means for electrical discharge thereat.

2. An article according to claim 1; wherein said electrical coupling thread means is sewn into said garment from said elastic wrist band to said electrical connection means in a zig-zag manner so as to cover and be electrically connected with portions of said grid.

3. An article according to claim 1; wherein said electrical coupling thread means includes a continuous non-conductive thread and a continuous metal thread relatively wrapped about each other.

4. An article according to claim 1; wherein said electrical coupling thread means extends from one wrist of said garment, up an inseam of a respective arm, down an inseam at a respective side of said garment to the waist section thereof and is connected to said electrical connection means.

5. An article according to claim 4; wherein said electrical coupling thread means extends from opposite cuffs of said garment, up both inseams of said arms of said garment, down inseams on both sides of said garment and around the back of the garment so as to electrically connect opposite cuffs of said garment.

6. An article according to claim 1; wherein said electrical connection means is at a front portion of said garment at said waist section.

* * * * *